US007493772B1

(12) United States Patent
Brown

(10) Patent No.: US 7,493,772 B1
(45) Date of Patent: Feb. 24, 2009

(54) ENHANCED NATURAL DRAFT VAPORIZER FOR CRYOGENIC FLUIDS

(75) Inventor: Ross M Brown, Murrieta, CA (US)

(73) Assignee: Cryoquip, Inc., Murrieta, CA (US)

( * ) Notice: Subject to any disclaimer, the term of this patent is extended or adjusted under 35 U.S.C. 154(b) by 415 days.

(21) Appl. No.: 11/378,775

(22) Filed: Mar. 20, 2006

(51) Int. Cl.
*F17C 9/02* (2006.01)

(52) U.S. Cl. ..... 62/50.2

(58) Field of Classification Search ..... 62/50.2
See application file for complete search history.

(56) References Cited

U.S. PATENT DOCUMENTS

| | | | | | |
|---|---|---|---|---|---|
| 872,129 | A | | 11/1907 | Heffley | |
| 3,124,940 | A | * | 3/1964 | Guelton | 62/284 |
| 3,293,871 | A | * | 12/1966 | Tyree, Jr. | 62/50.2 |
| 3,435,623 | A | * | 4/1969 | Tyree, Jr. | 62/50.2 |
| 3,618,332 | A | * | 11/1971 | Setzpfandt et al. | 62/600 |
| 3,633,374 | A | | 1/1972 | Canter | |
| 3,735,465 | A | | 5/1973 | Tibbetts et al. | |
| 4,133,184 | A | | 1/1979 | Bivins, Jr. | |
| 4,226,605 | A | * | 10/1980 | Van Don | 62/50.2 |
| 4,271,617 | A | | 6/1981 | Yoshizawa | |
| 4,329,842 | A | | 5/1982 | Hoskinson | |
| 4,487,256 | A | * | 12/1984 | Lutjens et al. | 165/76 |
| 4,766,736 | A | | 8/1988 | Waldschmidt | |
| 5,251,452 | A | * | 10/1993 | Wieder | 62/50.2 |
| 5,291,738 | A | | 3/1994 | Waldrop | |
| 7,137,623 | B2 | | 11/2006 | Mockry et al. | |

* cited by examiner

*Primary Examiner*—William C Doerrler
(74) *Attorney, Agent, or Firm*—William W. Haefliger

(57) ABSTRACT

In apparatus to convert cryogenic fluid to gas, a vaporizer having passages to pass the cool or cold cryogenic fluid in heat transfer relation with warming gas flowing downwardly through the vaporizer, structure extending below the level of the vaporizer to receive the downwardly flowing gas and to re-direct it to discharge to atmosphere, the structure including ducting configured and sized to enhance the down flow and discharge rates of the gas, whereby the temperature of the discharged gas is maintained above the level that would exist in the absence of the ducting, and potential fogging at the discharge is reduced.

17 Claims, 3 Drawing Sheets

ENHANCED DRAFT

ENHANCED NATURAL DRAFT VAPORIZER FOR CRYOGENIC FLUIDS

BACKGROUND OF THE INVENTION

This invention relates generally to improvements in the operation of natural draft type vaporizers for cryogenic fluids, and more particularly to the elimination or reduction of fogging, and achievement of higher effluent discharge rates, by vaporizer enhanced draft inducement methods.

A vaporizer consists of one or more vertical heat transfer element(s). The areas between the elements are open passages for ambient air to flow downward and in the process become cooled by the vaporizing cryogen on the insides of the elements. As the ambient air cools, it grows more dense. The temperature profile of the downflowing ambient air drops from the ambient air inlet temperature to some much lower temperature in the space between the elements. The exact profile is determined by the heat transfer characteristics, the moisture content and the frost deposited. The velocity of flowing ambient air is determined by the difference in densities of the two columns of air; one in the passage between the elements and the other the column of ambient air outside the vaporizer. This static pressure difference is converted into kinetic energy associated with the acceleration of the ambient air to the velocity in the passage and the friction losses plus the turning loss at the bottom of the vaporizer.

For any given vaporization load, and ambient condition, there is a specific velocity, and therefore mass flow rate that satisfies the balance. When the cold air effluent mixes with the outside ambient air, a fog can be generated where the two air masses join, this fogging problem being exacerbated when the ambient air is characterized by high humidity. This fog can be a nuisance or a hazard. Additionally the cold air discharge itself can be a nuisance or a hazard. The warmer the effluent, the less tendency to produce fog and the lesser the effects on the surrounding.

There is need for a simple, effective way to achieve warmer effluent discharge from the vaporizer, lessening the tendency to produce fog, as well as lessening adverse effects on open areas close to the vaporizer.

SUMMARY OF THE INVENTION

It is a major object of the invention to provide simple, efficiently operating structure associated with the vaporizer, that operates to achieve greater flow rates of ambient air through a vaporizer, whereby the ambient air flow discharge is warmer than it would otherwise be at lesser flow rates for the same size vaporizer. This objective is met by provision of the following:

a) a vaporizer having passages to pass the cool or cold cryogenic fluid in heat transfer relation with warming gas flowing downwardly through the vaporizer, b) structure extending below the level of the vaporizer to receive the downwardly flowing gas and to re-direct it to discharge to atmosphere, c) that structure including ducting configured and sized to enhance the down flow and discharge rates of the gas, whereby the temperature of the discharged gas is maintained above the level that would exist in the absence of said ducting, and fogging potential at discharge is reduced.

As will be seen, the ducting is typically located directly below the vaporizer; it opens upwardly toward the vaporizer to receive down flow of cooled ambient air, and it typically has side walls to block sideward escape of warming fluid from the ducting.

It is another object to provide structure associated with the vaporizer having a lower flow passing region positioned to receive said gas flow from the ducting and to redirect gas flow sidewardly from said region. In this regard, for a vaporizer having a downward gas (such as air) discharge flow area $A_1$, that lower region has a sideward effluent gas flow area $A_2$, where $A_2$ is related to $A_1$, for highest efficiency. Also, that region, in which the flow is turned sidewardly, is typically located directly below the ducting, which is below the vaporizer.

Further, when that flow region has an effective height X above ground level, the top of the ducting (proximate the bottom of the vaporizer) typically has an approximate height H above ground level, where H>X.

Further objects include the provision of legs supporting the vaporizer, and ducting that includes side panels supported by such legs. The duct may alternately be free standing, or may hang from the vaporizer or associated structure.

The described apparatus is very effective and efficient, when employed to convert LNG (liquefied natural gas) or other cryogens to gaseous state, for distribution, and when the warming gas is supplied to the vaporizer as ambient air flow. Such fluids may be categorized as having boiling points below −150° F.

The basic method includes the steps:

a) providing a vaporizer having passages to pass the cool or cold cryogenic fluid in heat transfer relation with warming gas flowing downwardly through the vaporizer, b) providing structure extending below the level of the vaporizer to receive the downwardly flowing gas and to redirect it to discharge to atmosphere, c) said structure including ducting configured and sized to enhance the down flow and discharge rates of said gas, whereby the temperature of the discharged gas is maintained above the level that would exist in the absence of said ducting, and potential fogging at said discharge is reduced. Adverse low temperature effects upon the surrounding area are also reduced.

These and other objects and advantages of the invention, as well as the details of an illustrative embodiment, will be more fully understood from the following specification and drawings, in which:

DRAWING DESCRIPTION

DETAILED DESCRIPTION

Figure 1:
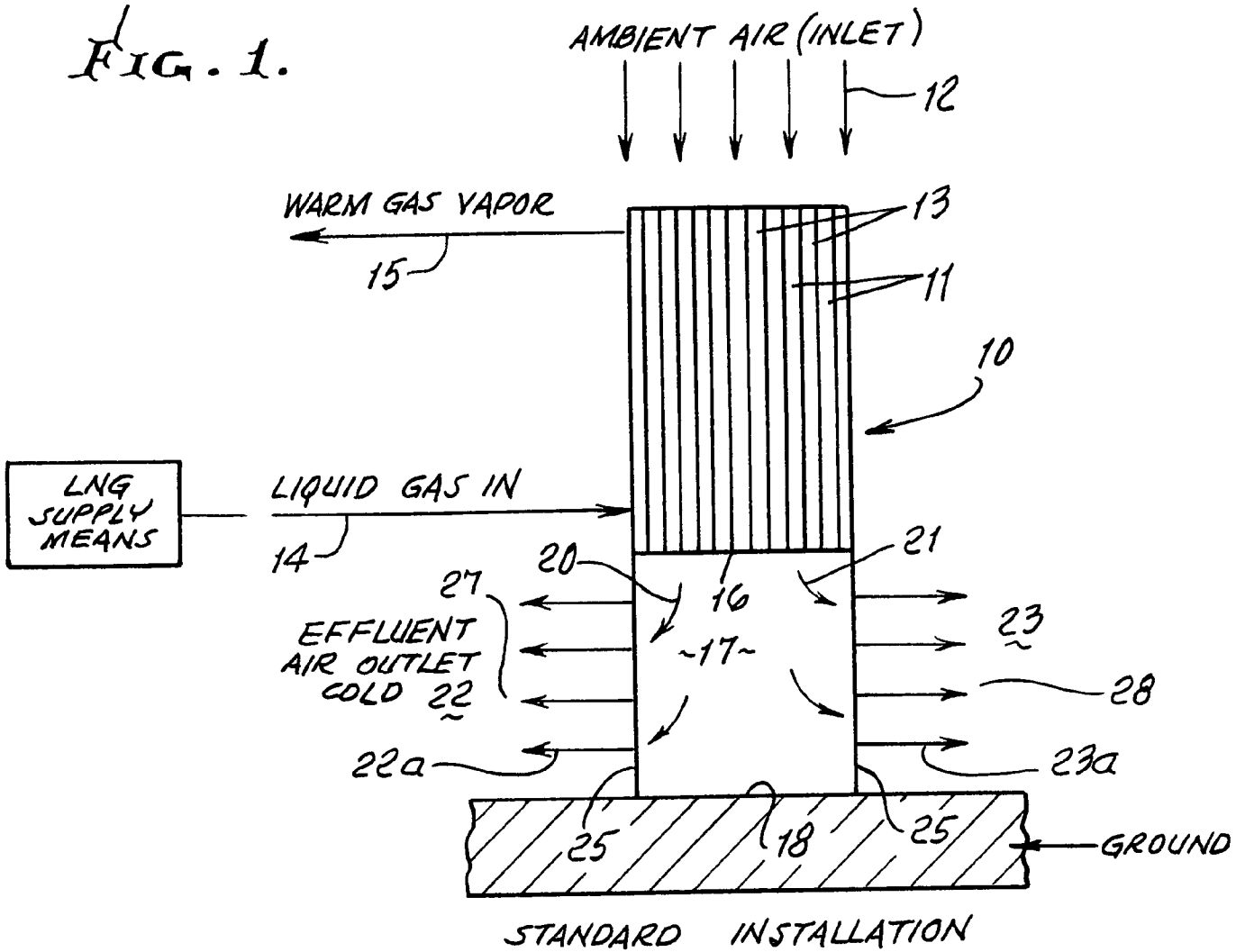
FIG. 1 is a schematic view of a standard liquefied gas vaporizer unit, to which ambient air is supplied.

FIG. 1 shows a vaporizer 10 having vertical conduits 11 to pass ambient air 12 downwardly in warming heat transfer relation (i.e. gasifying) with liquid gas flowing upwardly in other (alternate) vertical conduits 13. Liquefied gas (as for example LNG) enters the vaporizer at 14 in liquid state, and exits the vaporizer in gaseous state at 15. The vaporizer is typically of natural draft type. The cooled ambient air exits the vaporizer at its lower level 16, and enters a lower zone 17 beneath the vaporizer and ground level 18. The cooled ambient air flow turns at 20 and 21 to exit 17 as effluent air discharges or streams 22 and 23. Cooler or colder effluent streams exit the zone 17 at lowermost levels, as seen at **22*a* and 23*a*. Vaporizer support legs are seen at 25**.

As referred to, when the ambient air is characterized by high humidity, as for example at or near saturation, a fog can be produced at or near zone 17, and particularly when the cooled effluent streams 22 and 23 become mixed with external or environmental air, as at 27 and 28. The fog if it forms, is usually at some distance from the vaporizer discharge, where adequate mixing of the discharge with humid ambient air can take place.

Figure 2:
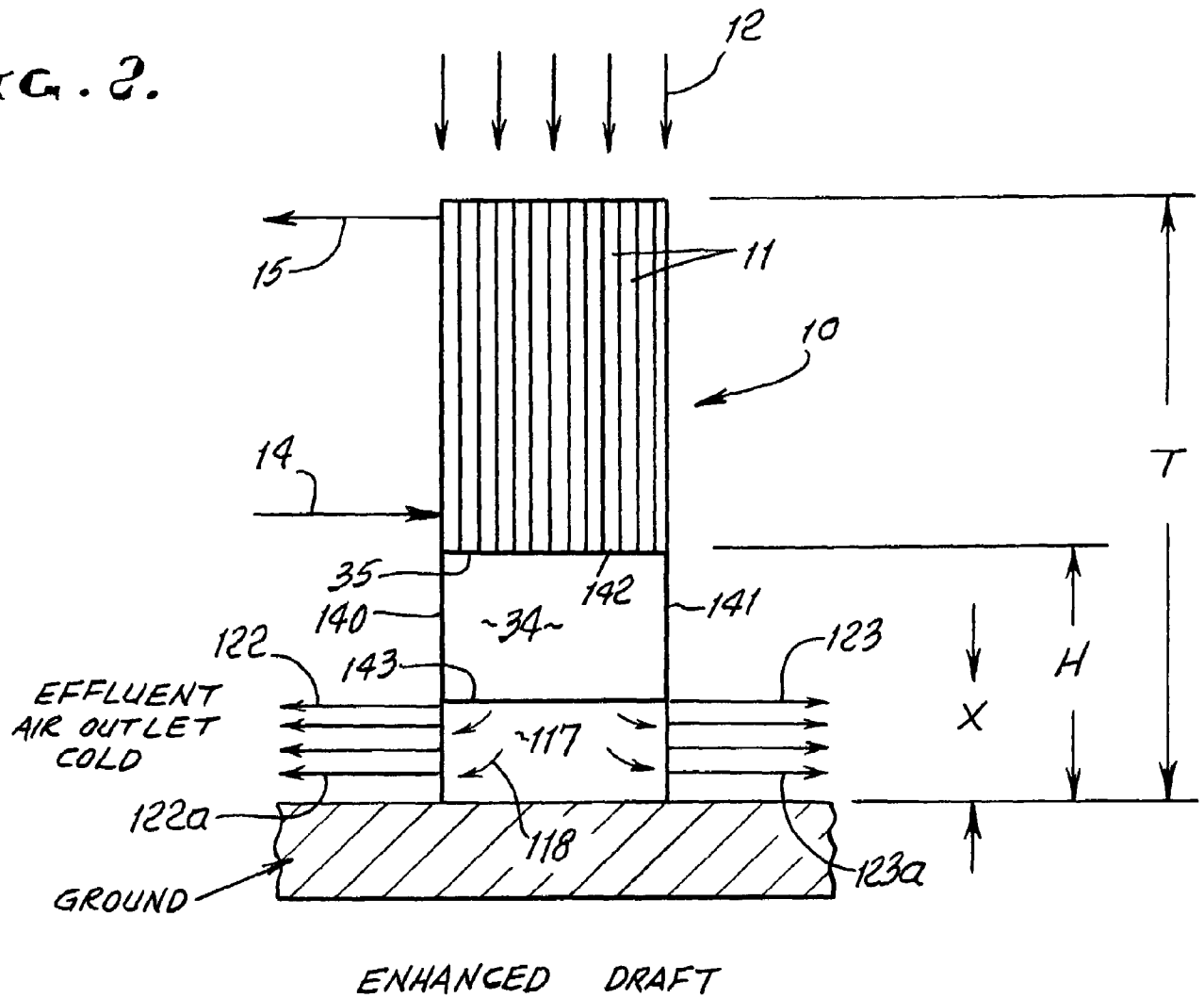
FIG. 2 is a schematic view of a preferred, enhanced draft installation, including a liquefied gas vaporizer unit, and ducting for draft enhancement.

To alleviate this problem, apparatus as shown in FIG. 2 is provided. Elements the same as those referred to in FIG. 1 are given the same identifying numerals.

Structure is provided below the level of the vaporizer to receive that downwardly flowing ambient air (or gas). That structure includes ducting, such as duct 34, for example, configured and sized to enhance the down flow and discharge rates of said gas, whereby the temperature of the discharged gas is maintained above the level that would exist in the absence of said ducting, and fogging at said discharge is reduced.

FIG. 2 shows the interposition of ducting or duct 34 between the bottom level 35 of the vaporizer, and the upper extent of the zone 117, and wherein the ambient air flow is turned as at 118 to exit the apparatus at 122 and 123, and at 122*a* and 123*a*, corresponding to 22, 23, 22*a* and 23*a* above. Duct side walls appear at 140 and 141, and may be formed by panels attached to vaporizer support legs. Horizontal lines 142 and 143 indicate the top and bottom levels of the duct, which are open, the duct extending vertically.

Figure 3:
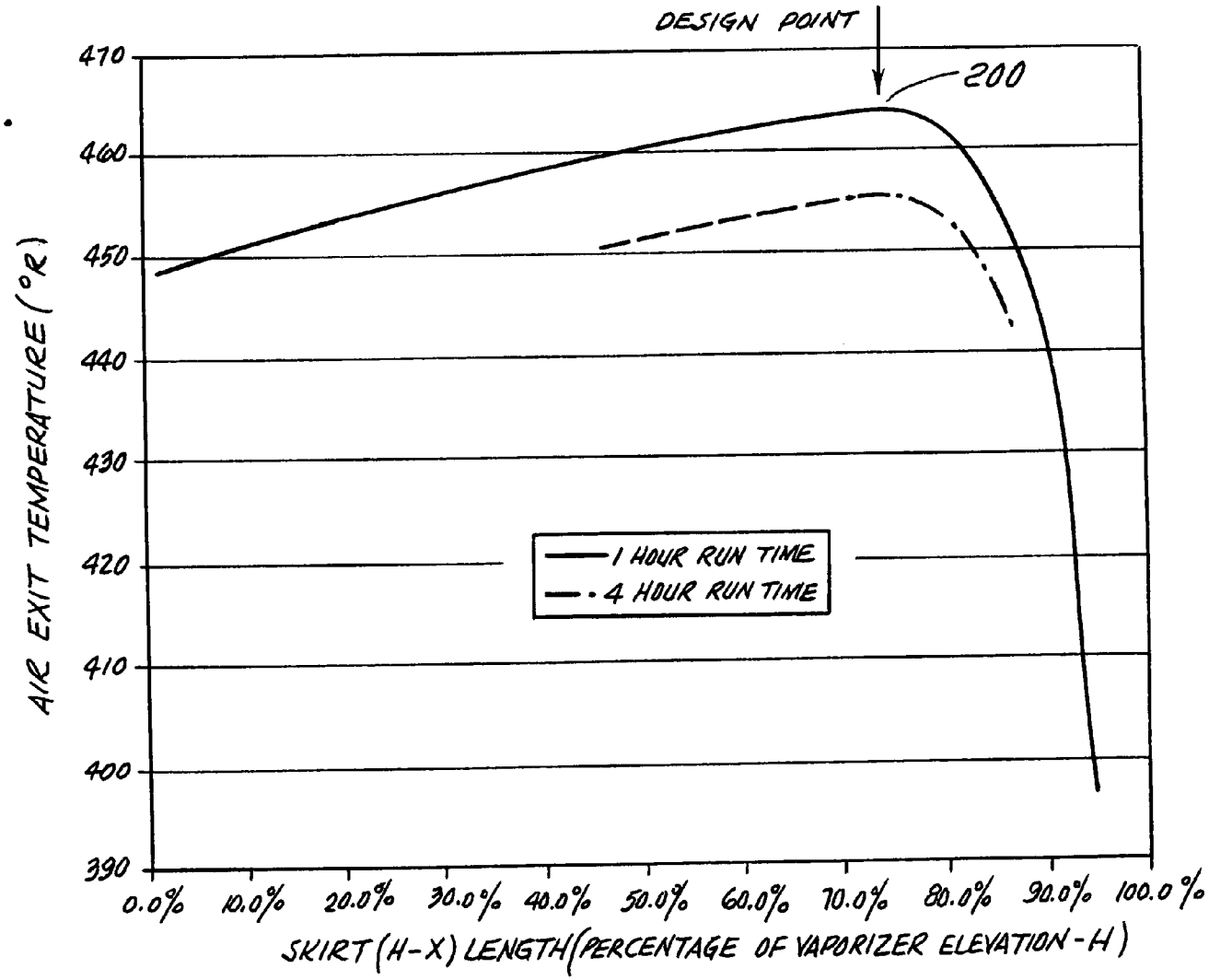
FIG. 3 is a graph.

FIG. 3 is a graph showing typical vaporizer exit air temperature versus skirt vertical length H-X, where the skirt may be formed as by panels 140 and 141. Note the indicated design point 200 at which exit air temperature is maximized.

SUMMARY

An important feature nature of this invention is revision of a method of improving the ambient air flow through the passages between the heat transfer elements. By use of a duct at the vaporizer bottom, an enclosed channel is formed for the cooled effluent. This height of cold air is denser than the ambient air on the outside of the duct, and the additional drive, resulting from the additional density difference caused by the duct, results in higher velocity of ambient air flows, which in turn means a higher effluent flow rate below the vaporizer and a warmed discharge.

The effluent air experiences a pressure drop as it turns from vertically down to horizontal at the bottom of the vaporizer's. The longer the duct, the smaller the opening between the bottom of the duct and the ground, and the higher the horizontal velocity, and the attendant turning losses. For each vaporizer configuration and loading, there is an optimum ratio of vaporizer height (T) to ground clearance height (H), and usually is close the point where the horizontal flow area bears a preferred relation to the free flow (down) area of the vaporizer for maximum efficiency. X is the height of the bottom level of the duct. The duct can be formed by attaching panels to the legs, enabling size tailored exit areas to fit the application. Other means for duct support can be provided as referred to above.

The vaporizer typically has downward gas flow area $A_1$, and the region 117 below the ducting typically has sideward discharge flow area $A_2$, where $A_2$ is typically the sum of the left and right discharge flow areas see in FIG. 2, and which are flow related for highest efficiency. The duct is preferably air tight in the sense that intrusion of ambient air to the duct interior is prevented, and in the sense that leakage of air form the duct interior to the outside is prevented, as via duct walls.

I claim:

1. In apparatus to convert cryogenic fluid to gas, a) a vaporizer having passages to pass the cool or cold cryogenic fluid in heat transfer relation with warming gas flowing downwardly through the vaporizer, b) structure extending below the level of the vaporizer to receive the downwardly flowing gas and to re-direct it to discharge to atmosphere, c) said structure including ducting configured and sized to enhance the down flow and discharge rates of said gas, whereby the temperature of the discharged gas is maintained above the level that would exist in the absence of said ducting, and potential fogging at said discharge is reduced, d) there being legs supporting the vaporizer, said ducting including upright side panels proximate the legs, and wherein said ducting is located directly below major lateral extent of the vaporizer, e) said structure having a lower flow passing region positioned to receive said gas flow from the ducting and to redirect gas flow sidewardly from said region, which is sidewardly open, below said side panels, f) said lower flow passing region located directly below said ducting, g) said lower flow passing region having transverse width substantially the same as the width of said vaporizer and of said ducting between said side panels.

2. The apparatus of claim 1 wherein the ducting opens upwardly toward the vaporizer, and said side panels block sideward escape of warming fluid from the ducting.

3. The apparatus of claim 1 wherein the vaporizer has downward gas discharge flow area $A_1$ and said lower flow passing region has a sideward gas discharge flow area $A_2$, and wherein $A_2$ is flow related to $A_1$ for maximum efficiency.

4. The apparatus of claim 1 wherein said lower flow passing region is located below the lowermost extents of the side panels.

5. The apparatus of claim 1 wherein said lower flow passing region has an approximate height X above ground level and the top of said ducting has an approximate height H, above ground level, and wherein H>X.

6. The apparatus of claim 1 wherein said side panels are supported by said legs.

7. The apparatus of claim 1 including means supplying LNG to said vaporizer for conversion to gas.

8. The apparatus of claim 1 wherein the vaporizer is a natural draft vaporizer and receives ambient air which is said warming gas.

9. In the method of converting cryogenic fluid to gas, the steps that include:

a) providing a vaporizer having passages passing the cool or cold cryogenic fluid in heat transfer relation with warming gas flowing downwardly through the vaporizer, b) providing structure extending below the level of the vaporizer to receive the downwardly flowing gas and to re-direct it to discharge to atmosphere, c) said structure including ducting configured and sized to enhance the down flow and discharge rates of said gas, whereby the temperature of the discharged gas is maintained above the level that would exist in the absence of said ducting, and fogging at said discharge is reduced, d) there being legs supporting the vaporizer, said ducting including upright side panels proximate the legs, and wherein said ducting is located directly below major lateral extent of the vaporizer, e) said structure having a lower flow passing region positioned to receive said gas flow from the ducting and to redirect gas flow sidewardly from said region, which is sidewardly open, below said side panels, f) said lower flow passing region located directly below said ducting, g) said lower flow passing region having transverse width substantially the same as the width of said vaporizer and of said ducting between said side panels.

10. The method of claim 9 wherein the ducting opens upwardly toward the vaporizer, and said side panels are positioned to block sideward escape of warming fluid from the ducting.

11. The method of claim 9 wherein the vaporizer has downward gas discharge flow area $A_1$ and said lower flow passage region has a sideward gas discharge flow area $A_2$, and wherein $A_2$ is related to $A_1$ for highest efficiency.

12. The method of claim 9 including locating said flow passing region directly below said ducting.

13. The method of claim 9 wherein said lower flow passage region has an approximate height X above ground level and the top of said ducting has an approximate height H, above ground level, and wherein H>X.

14. The method of claim 9 said side panels supported by said legs.

15. The method of claim 9 including supplying LNG to the vaporizer for conversion to natural gas.

16. The method of claim 9 wherein the vaporizer is a natural draft vaporizer and receives ambient air which is said warming gas.

17. The method of claim 9 wherein the cryogenic fluid is characterized as having a boiling point below −150° F.

* * * * *